United States Patent [19]

Toyama

[11] Patent Number: 4,873,743

[45] Date of Patent: Oct. 17, 1989

[54] HINGE

[75] Inventor: Hiroaki Toyama, Yamanashi, Japan

[73] Assignee: Kabushiki Kaisha Murakoshi Seiko, Tokyo, Japan

[21] Appl. No.: 291,521

[22] Filed: Dec. 29, 1988

[51] Int. Cl.[4] ..... E05F 1/14

[52] U.S. Cl. ..... 16/237; 16/240; 16/246; 16/249; 16/288; 16/291; 16/370; 16/382

[58] Field of Search ..... 16/236, 237, 238, 240, 16/245, 246, 249, 250, 251, 288, 291, 370, 382, 387, DIG. 43

*Primary Examiner*—Richard K. Seidel
*Assistant Examiner*—Edward A. Brown
*Attorney, Agent, or Firm*—James E. Nilles; Thomas F. Kirby

[57] ABSTRACT

A hinge having a base fixed to a piece of furniture and to which a pivotable member attached to a door is joined so that the pivotable member can be turned so as to be opened and closed, the hinge being fixed to a mounting member attached to a body of furniture. A rear screw engaged with the mounting member is inserted into and engaged with a recess in an upper wall of the base with the head of the rear screw positioned above the recess as the base is moved slidingly from the front side on the mounting member so as to be fitted thereon, and the head of a front screw which is engaged with the mounting member is opposed to an opening in the upper wall of the base from the lower side thereof so as to be engaged at least from the upper side with locking members on the base. The mounting member is made longitudinally symmetric, so that the base can be secured to the mounting member in two directions.

2 Claims, 7 Drawing Sheets

HINGE

BACKGROUND OF THE INVENTION

1. Field of the Invention

This invention relates to a hinge used to support a door on, for example, a body of a piece of furniture so that the door can be turned, and more particularly to the securing of a base of such a hinge to a mounting member attached to the body of a piece of furniture.

2. Description of the Prior Art

In a conventional hinge adapted to be secured at its base to an object article, such as a body of a piece of furniture via a mounting member, a screw engaged with an upper rear portion of the mounting member, into which the base is fitted, is engaged with a recess formed in a rear portion of an upper wall of the base, and a flange formed at the tip of a screw engaged with a front portion of the upper wall of the base is engaged with a recess formed in the upper front portion of the mounting member, whereby the base is secured to the mounting member, as disclosed in, for example, Japanese Utility Model Laid-open No. 136068/1986. Since the base is made longitudinally slidable with respect to these screws in the relative recesses, the position of the base in the longitudinal direction with respect to the mounting member can be regulated, and also, the angle of the base with respect to the mounting member can be regulated by driving forward and backward the front screw engaged with the base.

However, the above-described conventional hinge is very expensive because the front screw consists of a special screw having a flange at the tip thereof. Moreover, since threaded bores are formed in the mounting member and base, the manufacturing cost is high. In addition, the head portion of the front screw which is on the opposite side of the tip portion, and which constitutes an operating means, projects to the outside of the base, so that the appearance of the hinge is spoiled.

Since the direction in which the base is fixed to the mounting member is limited to one direction, the fixing efficiency is low.

SUMMARY OF THE INVENTION

The present invention has been developed with a view to solve the above-mentioned problems.

A first object of the present invention is to provide a hinge capable of regulating the position of its base with respect to a mounting member in the same manner as a conventional hinge and being manufactured at a lower cost, and having a beautiful appearance.

A second object of the present invention is to provide a hinge capable of securing its base to a mounting member easily.

The first object can be achieved by a hinge having a base, a pivotable member connected to the front portion of the base so that the pivotable member can be turned so as to be opened and closed, and a mounting member which is formed so that the base can be secured thereto, and which is adapted to be attached to an object article, the base consisting of an upper wall and side walls so as to have a substantially U-shaped cross section and so that the base can be fitted over the mounting member, the upper wall being provided with a longitudinally extending recess opened at the rear end thereof and opening in front of this recess, the side walls being provided with locking members in the portions thereof which are in the vicinity of the opening in the upper wall, rear and front screws the diameter of the heads of which is larger than the widths of the recess and opening in the upper wall of the base being engaged with the rear end front sections of the upper portion of the mounting member, the rear screw being engaged with the recess in the upper wall of the base with the head thereof positioned above the recess, to render the base longitudinally slidable, the head of the front screw being opposed from the lower side to the opening in the upper wall of the base and engaged at least from the upper side with the locking members on both side walls of the base to keep the base longitudinally slidable.

The second object can be achieved by making longitudinally symmetric the mounting member with which the screws are engaged in the above-described hinge.

In order to secure the hinge according to the present invention to a piece of furniture by fixing the base, to which the pivotable member attached to a door of the furniture is joined so that the pivotable member can be turned so as to be opened and closed, to the mounting member attached to a body of the furniture, an object article, the rear screw engaged with the mounting member is inserted into and engaged with the recess in the upper wall of the base with the head of the rear screw positioned above the recess as the base is moved slidingly from the front side on the mounting member so as to be fitted thereon, and the head of the front screw which is engaged with the mounting member is opposed to the opening in the upper wall of the base from the lower side thereof so as to be engaged at least from the upper side with the locking members on the base. When the rear screw is tightened, the upper wall of the base is clamped by the head of this screw and the upper surface of the mounting member, and the upper wall of the base is pressed from the upper side against the head of the front screw with this head substantially clamped from the upper and lower sides thereof by, for example, the upper wall of the base and the locking members on the side walls thereof, whereby the base is fixed to the mounting member. When the base is moved slidingly in the longitudinal direction with respect to the mounting member with, especially, the rear screw loosened, to regulate the position of the base in the longitudinal direction, the base is moved slidingly in the longitudinal direction with the recess therein displaced in the longitudinal direction with respect to the rear screw, and the upper wall of the base and the locking members on both side walls thereof are displaced longitudinally with the head of the front screw surrounded thereby. The front screw is turned via the opening in the base so as to move the screw upwards and downwards, whereby the front portion of the base, in which the head of this screw is held between the upper wall of the base and the locking members on the side walls thereof, is moved vertically to regulate the angle of the base with respect to the mounting member.

In the hinge according to the present invention, the mounting member with which the screws are engaged is made longitudinally symmetric, so that the base can be secured to the mounting member in two directions.

The above and other objects and characteristic features of the present invention will become apparent from the following description of embodiments thereof taken in conjunction with the accompanying drawings.

DESCRIPTION OF THE PREFERRED EMBODIMENTS

Figure 1:
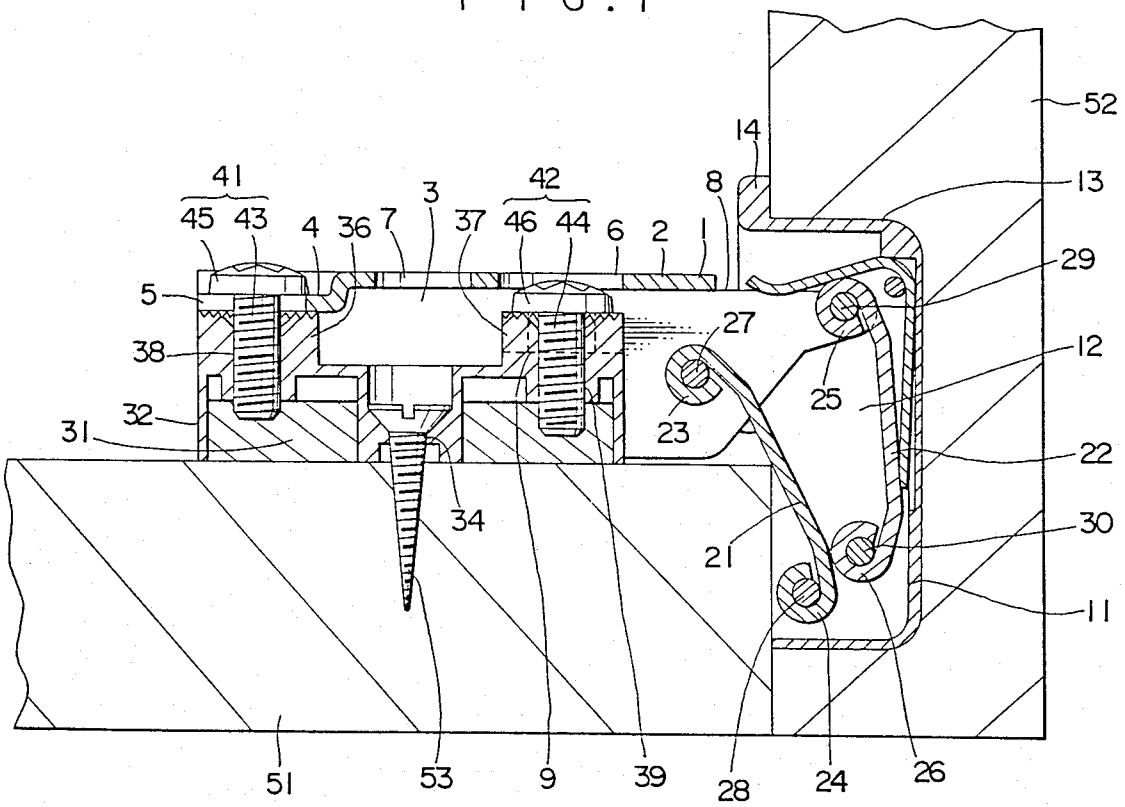
FIG. 1 is a longitudinal section of a first embodiment in a closed state of the hinge according to the present invention.
Figure 2:
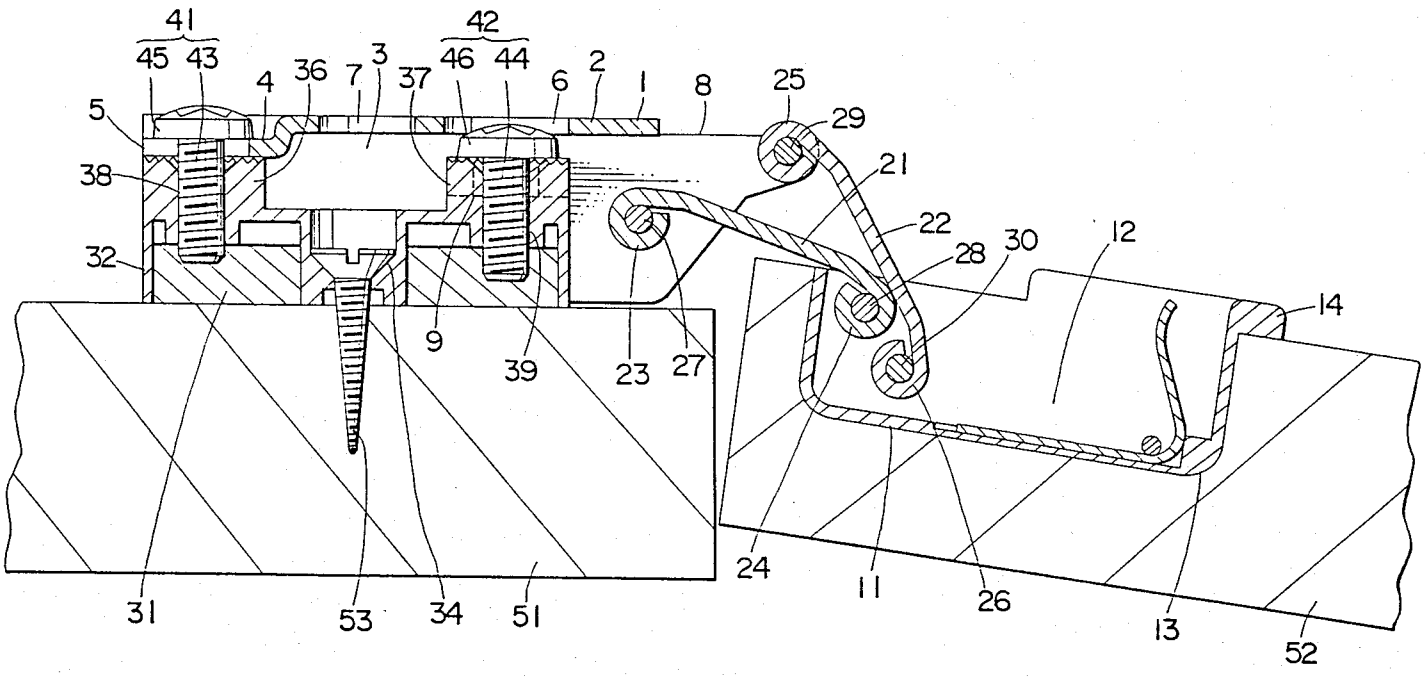
FIG. 2 is a longitudinal section of the same embodiment in an opened state.
Figure 3:
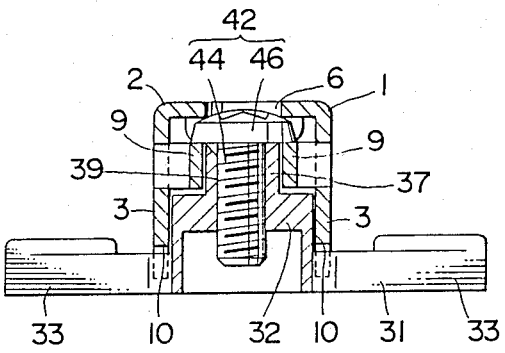
FIG. 3 is a sectioned front elevation of the portion of the same embodiment which is in the vicinity of a front screw.
Figure 4:
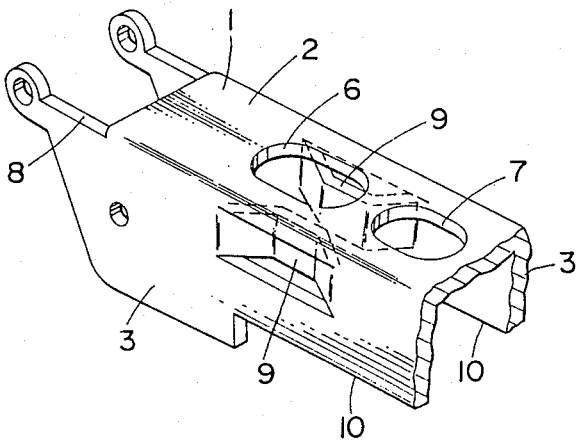
FIG. 4 is a perspective view of a front portion of a base of the same embodiment.
Figure 5:
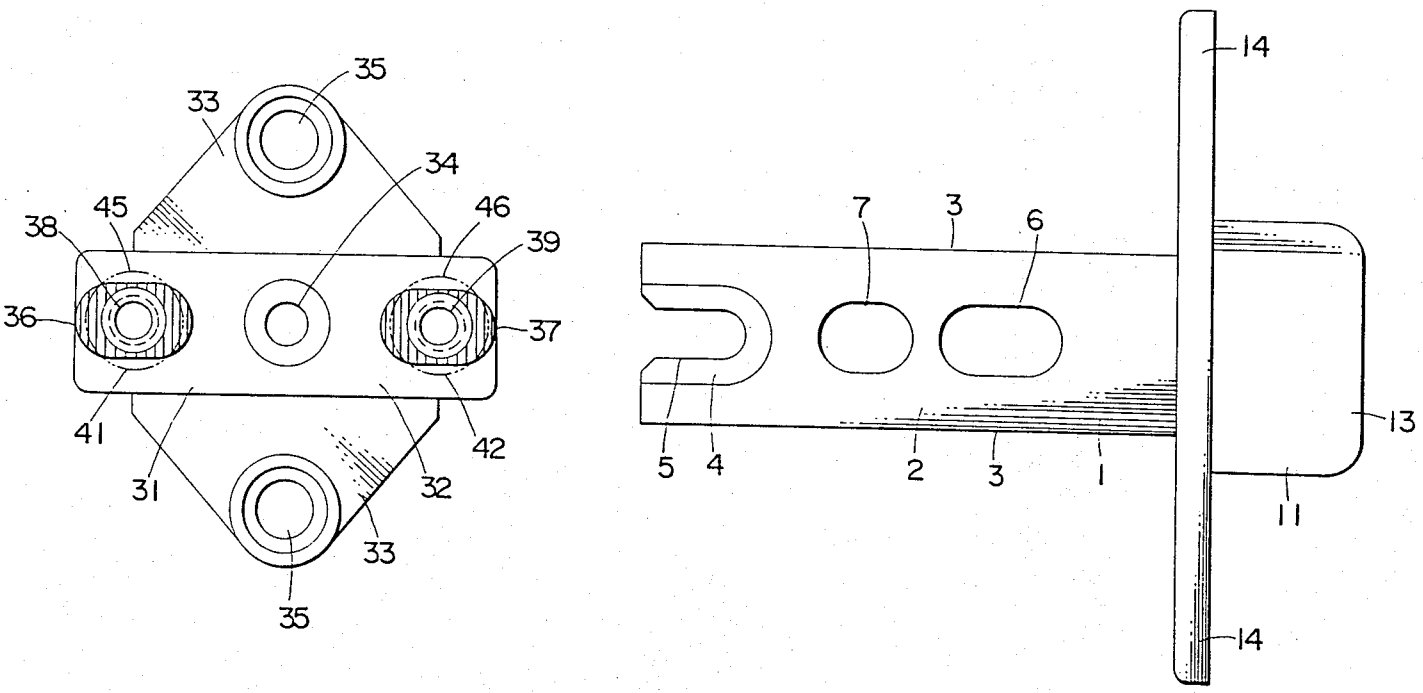
FIG. 5 is a plan view of the base.
Figure 5A:
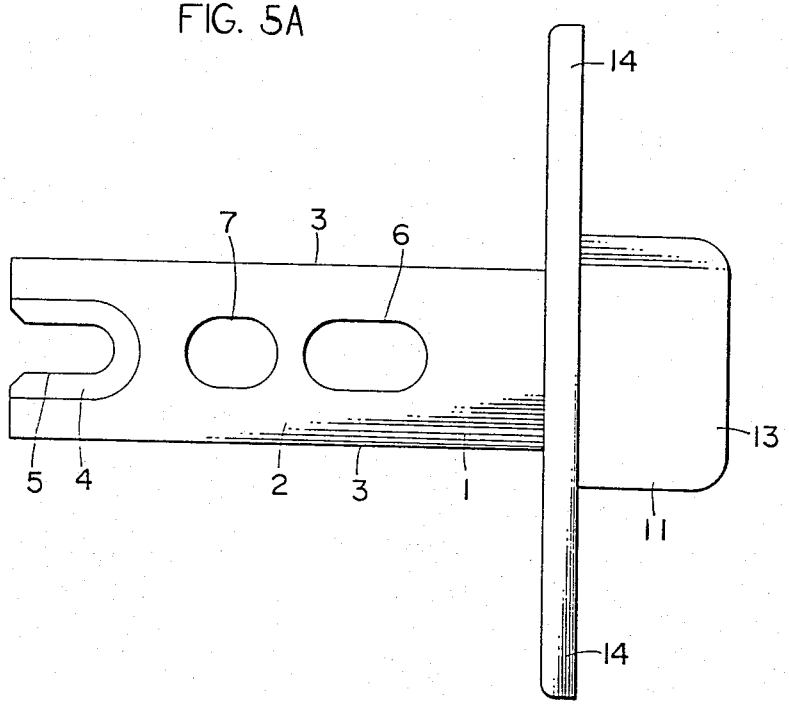
FIG. 5A is a plan view of a mounting portion.
Figure 5:
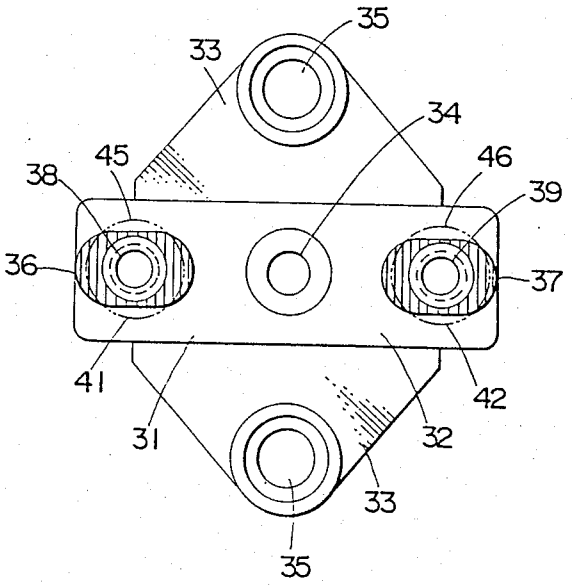

Reference numeral 1 denotes a base formed by pressing a metal plate, and consisting of an upper wall 2 and two side walls 3, which extend perpendicularly downward from both side edges of the upper wall 2, in such a manner that the base 1 has a substantially U-shaped cross section. The upper wall 2 is provided at the rear end portion thereof with a hollow 4, in which a recess 5 extending longitudinally to the rear end of the upper wall 2 is formed. The upper wall 2 is further provided at an intermediate portion thereof with a first longitudinally extending opening 6, and at a portion thereof which is between this first opening 6 and the hollow 4 with a second longitudinally extending opening 7. The upper wall 2 is further provided at its front end portion with a recess 8. Both side walls 3 are provided at portions thereof which are in the vicinity of both sides of the first opening 6 with projections 9 having a substantially trapezoidal shape in plan, constituting horizontal locking members and formed so as to be swollen inward, and at the lower edge portions thereof with recesses 10.

Reference numeral 11 denotes a pivotable member, which is formed out of a plastic, and which consists of a cap portion 13 having a one-side-opened recess 12, and mounting portions 14 projecting in the opposite lateral directions from the opened side of the cap portion 13. These mounting portions 14 have through bores (not shown).

Reference numerals 21, 22 denote first and second link arms, which are formed by bending metal plates, and which have at both of their end sections substantially cylindrical bearing portions 23, 24, 25, 26 made by bending the mentioned sections. The first link arm 21 is supported at its base end portion pivotably on vertically intermediate sections of the front portions of both side walls 3 of the base via a laterally extending support shaft 27 inserted through the bearing portion 23, and at its outer end portion pivotably on opened side portions of the lower end section shown in FIG. 1 of the recess 12 in the pivotable member 11 via a laterally extending support shaft 28 inserted through the bearing portion 24. The second link arm 22 is supported at its base end portion pivotably on the uppersides of the front end portions of the side walls 3 of the base 1 via a laterally extending support shaft 29 inserted through the bearing portion 25, and at its outer end portion pivotably on deeper sections of the lower end portion shown in FIG. 1 of the recess 12 in the pivotable member 11 via a laterally extending support shaft 30 inserted through the bearing portion 26. The pivotable member 11 is thus connected to the base 1 so that it can be turned so as to be opened and closed.

Reference numeral 31 denotes a mounting member, which is formed out of a metal, and which consists of a main body 32 around which the base 1 is fitted, and mounting portions 33 projecting from the lower sections of both side surfaces of the main body 32. Vertically extending through bores 34, 35 are provided in the central portion of the main body 32 and in the mounting portions 33. The main body 32 is provided on the rear and front portions of the upper surface thereof with projections 36, 37, in which threaded bores 38, 39 are formed, which extend vertically, and which are opened at least at the upper surfaces of these projections 36, 37. This mounting member 31 has a longitudinally symmetric shape.

Reference numerals 41, 42 denote screws of the same shape, which consist of respective threaded portions 43, 44, and heads 45, 46 the diameter of which is larger than that of the threaded portions 43, 44, and which are engaged with the threaded bores 38, 39 in the mounting member 31 so that the screws 41, 42 can be turned vertically. The width of the recess 5 and first opening 6 in the base 1 is set smaller than the diameter of the heads 45, 46 of the screws 41, 42. Especially, the width of the recess 5 is set larger than the diameter of the threaded portion 43.

In order to secure a door 52 to a body 51 of a piece of furniture so that the door 52 can be opened and closed, the cap portion 13 of the pivotable member 11 is buried in the door 52, and the mounting portions 14 of the pivotable member 11 are fixed to the door 52 by screws, whereby the pivotable member 11 is attached to the door 52. The screws 53 inserted into the through bores 34, 35 in the mounting member 31 are engaged with the body 51, so that the mounting member 31 is secured to the resultant body 51 as an object article.

In order to secure the base 1 to this mounting member 31, the base 1 is moved slidingly from the front side on the main body 32 of the mounting member 31 so as to be fitted therearound, and the rear screw 41 engaged with the mounting member 31 is inserted into and engaged with the recess 5 in the upper wall 2 of the base 1 with its head 45 positioned above this recess 5, while the head 46 of the front screw 42 engaged with the mounting member 31 is inserted from the rear side between the upper wall 2 of the base 1 and the projections 9 on the side walls 3 positioned under the upper wall 2. Consequently, the head 46 of the front screw 42 is substantially sandwiched at both sides thereof from the upper and lower sides between the upper wall 2 and projections 9, and positioned in opposition to the first opening 6 in the upper wall 2. The projections 9 on the two side walls 3 of the base 1 are positioned holding the front projection 37 of the mounting member 31 therebetween. The second opening 7 is positioned in opposition to the through bore 34 in the main body 32 of the mounting member 31. When the rear screw 41 engaged with the mounting member 31 is then tightened, the head 45 thereof and the upper surface of the rear projection 36 of the mounting member 31 sandwich the upper wall 2 of the base 1, and the upper wall 2 of the base 1 is pressed from the upper side against the head 46 of the front screw 42, so that the base 1 is fixed firmly to the mounting member 31. The recesses 10 in the two side walls 3 of the base are fitted around the base sections of the mounting portions 33 of the mounting member 31.

For example, in order that the door 52 is opened and closed properly, the position of the base 1 in the longitudinal direction with respect to the mounting member 31 and the angle of the base 1 with respect thereto can be regulated.

The position of the base 1 in the longitudinal direction can be regulated by moving the base 1 slidingly longitudinally with respect to the mounting member 31 with, especially, the rear screw 41, which is engaged with the mounting member 31, loosened. During this time, the rear screw 41 is moved slidingly in the longitudinal direction within the recess 5 in the base 1, while the head 46 of the front screw 42 is moved slidingly between the upper wall 2 of the base 1 and the projections 9 on the two side walls 3 thereof.

The angle of the base 1 with respect to the mounting member 31 can be regulated by turning the front screw 42 via the first opening 6 in the base to move the same upwards and downwards, whereby the front side of the base 1, the upper wall 2 and the projections 9 on the side walls 3 of which clamp the head 46 of this screw from the upper and lower sides thereof, is moved vertically.

After these regulating operations have been completed, the rear screw 41 is tightened as necessary.

According to the above-described arrangement, regular commercially available screws can be used as the screws 41, 42 for securing the base 1 to the mounting member 31, and it is not necessary to use any specially made screws, so that the manufacturing cost can be reduced. Moreover, even though the regular screws 41, 42 are used, the regulation of the longitudinal position and angle of the base 1 with respect to the mounting member 31 can be carried out easily and reliably.

Since the pressing of the base having swollen projections 9 can be done by using a progressive mold, the manufacturing cost does not increase. The manufacturing cost rather decreases since the base 1 has no threaded bores and does not require a tapping step. On the other hand, it is necessary that two threaded bores 38, 39 be formed in the mounting member 31 but they can be made with a minimal manufacturing effort since a simultaneous tapping method can be employed. Therefore, this enables the reduction of the overall manufacturing cost in comparison with the techniques which would be used to form one threaded bore in each of the base and mounting member.

Even when, especially, the front screw 42 is turned, the head 46 thereof is always positioned in contact from the lower side with the upper wall 2 of the base 1. Namely, the front screw 42 as a whole is always positioned in the interior of the base 1 and does not project to the outer side thereof. Accordingly, this hinge has a beautiful appearance.

Since the mounting member 31 including the screws 41, 42 engaged therewith has a longitudinally symmetric shape, the base 1 can be secured thereto in two directions. Namely, this hinge has a high degree of freedom of directing the same when the base 1 is secured to the mounting member 31 before the mounting member 31 has been fixed to the body 51 of a piece of furniture, r when the mounting member 31 is fixed to the body 51 before the base 1 has been secured to the mounting member 31. This enables the part-fixing operations to be carried out easily.

Figure 6:
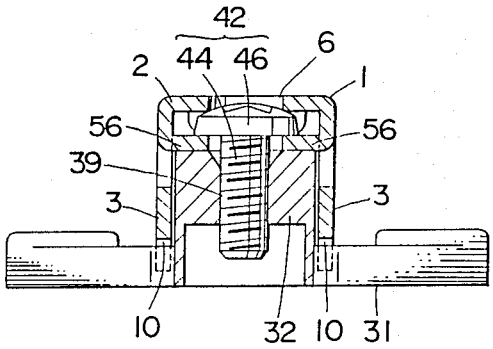
FIG. 6 is a sectioned front elevation of the portion of a second embodiment of the present invention which is in the vicinity of a front screw.
Figure 7:
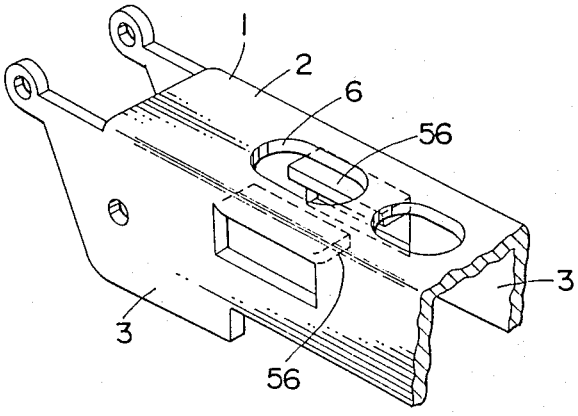
FIG. 7 is a perspective view of a front portion of a base of a second embodiment.

FIGS. 6 and 7 show a second embodiment of the present invention, in which the locking portions engaged from the lower side with both sides of the head 46 of the front screw 42 are formed as horizontal portions 56 obtained by cutting and raising the predetermined portions of the two side walls 3 of the base 1.

Figure 8:
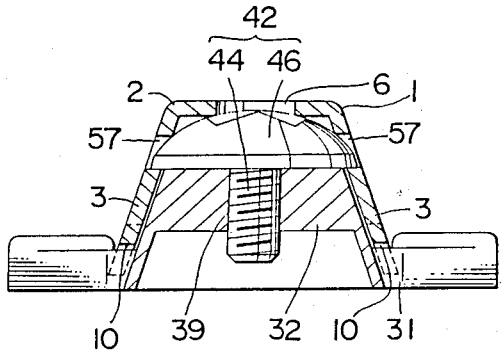
FIG. 8 is a sectioned front elevation of the portion of a third embodiment of the present invention which is in the vicinity of a front screw.
Figure 9:
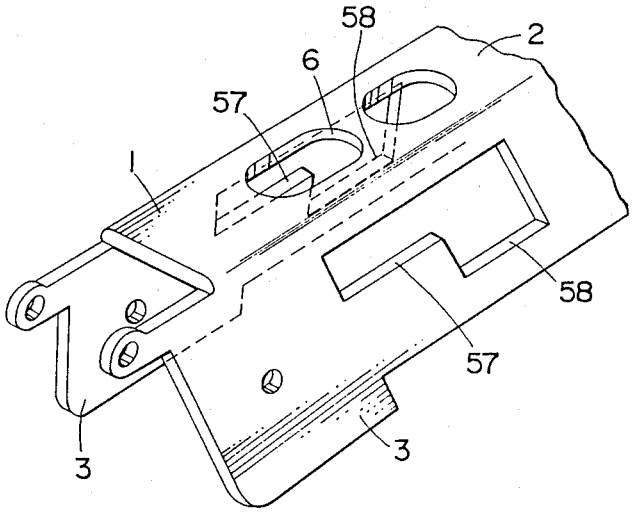
FIG. 9 is a perspective view of a front portion of a base of the third embodiment.

FIGS. 8 and 9 show a third embodiment of the present invention, in which the locking portions engaged with both sides of the head 46 of the front screw 42 are formed as locking bores 57 provided in the two side walls 3 of the base 1. Both side portions of the head 46 of the front screw 42 are inserted into these locking bores 57, and the lower edges of these locking bores contact both sides of the head 46 from the lower side thereof. The two side walls 3 of the base 1 are inclined so that the distance therebetween increases in the downward direction, and the rear portions of the locking bores 57 are bent down so as to form inlet ports 58. When this base is moved slidingly in the downward direction and then in the rearward direction to fit the same around the mounting member 31 during an operation for securing the base 1 to the mounting member 31, both side portions of the head 46 of the front screw 42 are introduced via the inlet ports 58, which are away from each other by a distance larger than the diameter of this head 46, into the front portions, which are away from each other by a distance substantially equal to the diameter of the head, of the locking bores 57. In this third embodiment, the upper wall 2 of the base 1 may be engaged with the head 46 of the front screw 42 from the upper side thereof in the same manner as in the first and second embodiments so as to secure the base 1 to the mounting member 31, however, the upper edges of the locking bores 57 may be engaged with the head 46 of the screw from the upper side thereof.

According to the present invention, the front screw out of a pair of screws for use in securing the base to the mounting member is also formed as a screw consisting of a threaded portion and a larger-diameter head and the head of this screw is opposed from the lower side to the opening in the upper wall of the base and engaged at least from the upper side with the locking members on the base, whereby the base is engaged with the mounting member so that the base can be moved slidingly in the longitudinal direction. Therefore, in addition to the advantage that the longitudinal position and angle of the base with respect to the mounting member can be regulated, regular screws can be used as the screws for securing the base to the mounting member, so that the manufacturing cost can be reduced, and the threaded bores may be formed in the mounting member only. Therefore, collectively speaking, the manufacturing of the base and mounting member can be done more easily. Moreover, since the head of the front screw is always positioned in opposition to the opening, the width of which is smaller than the diameter of the head, from the lower side thereof and does not project to the outer side of the base, the outer appearance of this hinge can be kept beautiful.

According to the present invention, the mounting member with which the screws are engaged is formed to a longitudinally symmetric shape. This enables the base to be secured to the mounting member in two directions, and the part-fixing operations to be carried out easily.

What is claimed is:

1. In a hinge comprising a base having a front portion and a rear portion, a pivotable member connected to the front portion of the base so that the pivotable member can be turned so as to be opened and closed , and a mounting member having an upper portion with front and rear sections which is formed so that the base can be secured thereto, and which is adapted to be attached to an object article, the improvement characterized in that said base consists of an upper wall having a front end and a rear end and upper and lower sides and side wall so as to have a substantially U-shaped cross section and so that the base can be fitted over the mounting member, said upper wall is provided with a longitudinally extending recess having a width and being opened at the rear end thereof and an opening having a width and being located in front of this recess, said side walls are provided with locking members in the portions thereof which are in the vicinity of the opening in the upper wall, said locking members having upper sides, rear and front screws having heads with upper and lower sides and diameters which are larger than the width of the recess and the opening in the upper wall of the base, the heads of the screws are engaged with the rear and front sections of the upper portion of the mounting member, said rear screw is engaged with the recess in the upper wall of the base with the head thereof positioned above the recess, to render the base longitudinally slidable, and said head of the front screw is located below the upper wall of said base and opposite from the lower side of said upper wall to the opening in the upper wall of the base and engaged at least from the upper side with the upper sides of the locking members on both side walls of the base to keep the base longitudinally slidable.

2. In a hinge having a base having a front portion and rear portion, a pivotable member connected to the front portion of the base so that the pivotable member can be turned so as to be opened and closed, and a mounting member having an upper portion with front and rear sections which is formed so that the base can be secured thereto, and which is adapted to be attached to an object article, the improvement characterized in that said base consists of an upper wall having a front end and rear end and upper and lower sides and side walls so as to have a substantially U-shaped cross section and so that the base can be fitted over the mounting member, said upper wall is provided with a longitudinally extending recess having a width and being opened at the rear end thereof and an opening having a width and being located in front of this recess said side walls are provided with locking members in the portions thereof which are in the vicinity of the opening in the upper wall, said locking members having upper sides, rear and front screws having heads with upper and lower sides and diameters which are larger than the widths of the recess and the opening in the upper wall of the base, the heads of the screws are engaged with the rear and front sections of the upper portion of the mounting member, said rear screw is engaged with the recess in the upper wall of the base with the head thereof positioned above the recess, to render the base longitudinally slidable, said head of the front screw is located below the upper wall of said base and opposite from the lower side of upper wall to the opening in the upper wall of the base and engaged at least from the upper side with the upper sides of the locking members on both side walls of the base to keep the base longitudinally slidable, and said mounting member is formed to a longitudinally symmetric shape.

* * * * *